US007469891B2

(12) United States Patent
Takahashi

(10) Patent No.: US 7,469,891 B2
(45) Date of Patent: Dec. 30, 2008

(54) IMAGE FORMING APPARATUS

(75) Inventor: Satoru Takahashi, Osaka (JP)

(73) Assignee: Kyocera Mita Corporation (JP)

( * ) Notice: Subject to any disclaimer, the term of this patent is extended or adjusted under 35 U.S.C. 154(b) by 276 days.

(21) Appl. No.: 11/582,176

(22) Filed: Oct. 17, 2006

(65) Prior Publication Data

US 2007/0090589 A1 Apr. 26, 2007

(30) Foreign Application Priority Data

Oct. 21, 2005 (JP) ..... 2005-306995

(51) Int. Cl.
*B65H 1/00* (2006.01)

(52) U.S. Cl. ..... 271/162; 271/164

(58) Field of Classification Search ..... 271/162, 271/163, 164; 347/104; 399/393
See application file for complete search history.

(56) References Cited

U.S. PATENT DOCUMENTS 5,044,705 A * 9/1991 Nelson ..... 312/228
5,313,257 A * 5/1994 Kashima et al. ..... 399/393
2004/0065507 A1* 4/2004 Jacobsen ..... 181/290

FOREIGN PATENT DOCUMENTS

JP 5-51136 3/1993

* cited by examiner

*Primary Examiner*—David H Bollinger
(74) *Attorney, Agent, or Firm*—Gerald E. Hespos; Anthony J. Casella

(57) ABSTRACT

Disclosed is an image forming apparatus, which comprises a sheet feed cassette adapted to be insertingly mounted in a sheet feed section of an apparatus body in such a manner that it can be pulled out frontward, a cover member attached to an upper edge of an opening which is formed in a rear portion of the apparatus body to allow a rear portion of the sheet feed cassette mounted in the sheet feed section to protrude rearward therefrom, and adapted such that, when the rear portion of the sheet feed cassette is located to protrude from the opening, it covers an upper surface of the protruded rear portion of the sheet feed cassette, and a noise absorbing material attached onto a surface of the cover member adapted to be located in opposed relation to the sheet feed cassette.

6 Claims, 8 Drawing Sheets

IMAGE FORMING APPARATUS

BACKGROUND OF THE INVENTION

1. Field of the Invention

The present invention relates to an image forming apparatus equipped with a sheet feed cassette.

2. Description of the Related Art

Heretofore, there has been known an image forming apparatus, such as a printer, equipped with a sheet feed cassette adapted to storably receive therein a plurality of sheets (recording sheets) and to be insertingly mounted in a sheet feed section of an apparatus body in a drawer-like manner. In connection with recent downsizing of OA apparatuses, for example, one type of image forming apparatus is widely prevalent which is designed to use a A4 sheet as a standard sheet, and arrange manual operating means, such as means for insertion/pullout of the sheet feed cassette and means for manual sheet feed, on the side of a front surface of an apparatus body in a concentrated manner so as to provide enhanced operationality thereof. In this type of image forming apparatus, a sheet feed roller and other associated component are arranged in the vicinity of the front surface of the apparatus body, and a sheet feed cassette is inserted into the apparatus body in such a manner that a front portion thereof becomes approximately flush with the front surface of the apparatus body.

There is one type of sheet, so-called "legal-size sheet" primarily used in the United States etc., which has a width approximately equal to that of the A-4 sheet and a height or length greater than that of the A-4 sheet. Generally, a sheet feed cassette for storably receiving therein the legal-size sheets has a longitudinal dimension greater than that of the apparatus body of the above type of image forming apparatus. Thus, for the purpose of adequately mounting this sheet feed cassette in the image forming apparatus, the apparatus body has a rear portion formed with an opening for allowing a rear portion of the sheet feed cassette to protrude rearward therefrom. In this case, the exposed rear portion of the sheet feed cassette is likely to permit mote, dust and/or moisture to get into the apparatus body therefrom, resulting in occurrence of a disadvantage, such as void, thin spot or roll contamination. Moreover, if the sheet feed cassette is left for long periods of time, an exposed portion of a sheet stored in the sheet feed cassette will be disadvantageously discolored.

As measures for solving these disadvantages, there has been known a technique using a cover member attached around the opening of the apparatus body and adapted to be slidably or rotatably moved in conjunction with a protruding movement of the rear portion of the sheet feed cassette so as to cover an upper surface of the rear portion of the sheet feed cassette (see, for example, Japanese Patent Laid-Open Publication No. 05-51136).

The cover member as used in the above technique for the image forming apparatus is intended to prevent the intrusion of a foreign substance, such as dust, and therefore designed without taking particular account of measures against a phenomenon that, when the sheet feed cassette is mounted to protrude from the apparatus body, internal operating noises (such as sheet pickup noise, driving noise and sheet transport noise during a sheet feeding operation) of the apparatus body will leak outside through the sheet feed cassette and the opening. Thus, there is a problem that, when the sheet feed cassette is mounted to protrude from the apparatus body, the leakage of internal operating noises of the apparatus body becomes prominent.

SUMMARY OF THE INVENTION

In order to solve the above problem, it is an object of the present invention to provide an image forming apparatus capable of preventing internal operating noises of an apparatus body from leaking outside when a sheet feed cassette is mounted to protrude from an apparatus body.

According to one aspect of the present invention, there is provided an image forming apparatus which comprises a sheet feed cassette adapted to be insertingly mounted in a sheet feed section of an apparatus body in such a manner that it can be pulled out frontward, a cover member attached to an upper edge of an opening formed in a rear portion of the apparatus body to allow a rear portion of the sheet feed cassette mounted in the sheet feed section to protrude rearward therefrom, and adapted such that, when the rear portion of the sheet feed cassette is located to protrude from the opening, it covers an upper surface of the protruded rear portion of the sheet feed cassette, and a noise absorbing material attached onto a surface of the cover member adapted to be located in opposed relation to the sheet feed cassette.

DETAILED DESCRIPTION OF THE PREFERRED EMBODIMENTS

With reference to the drawings, an embodiment of the present invention will now be described.

Figure 1:
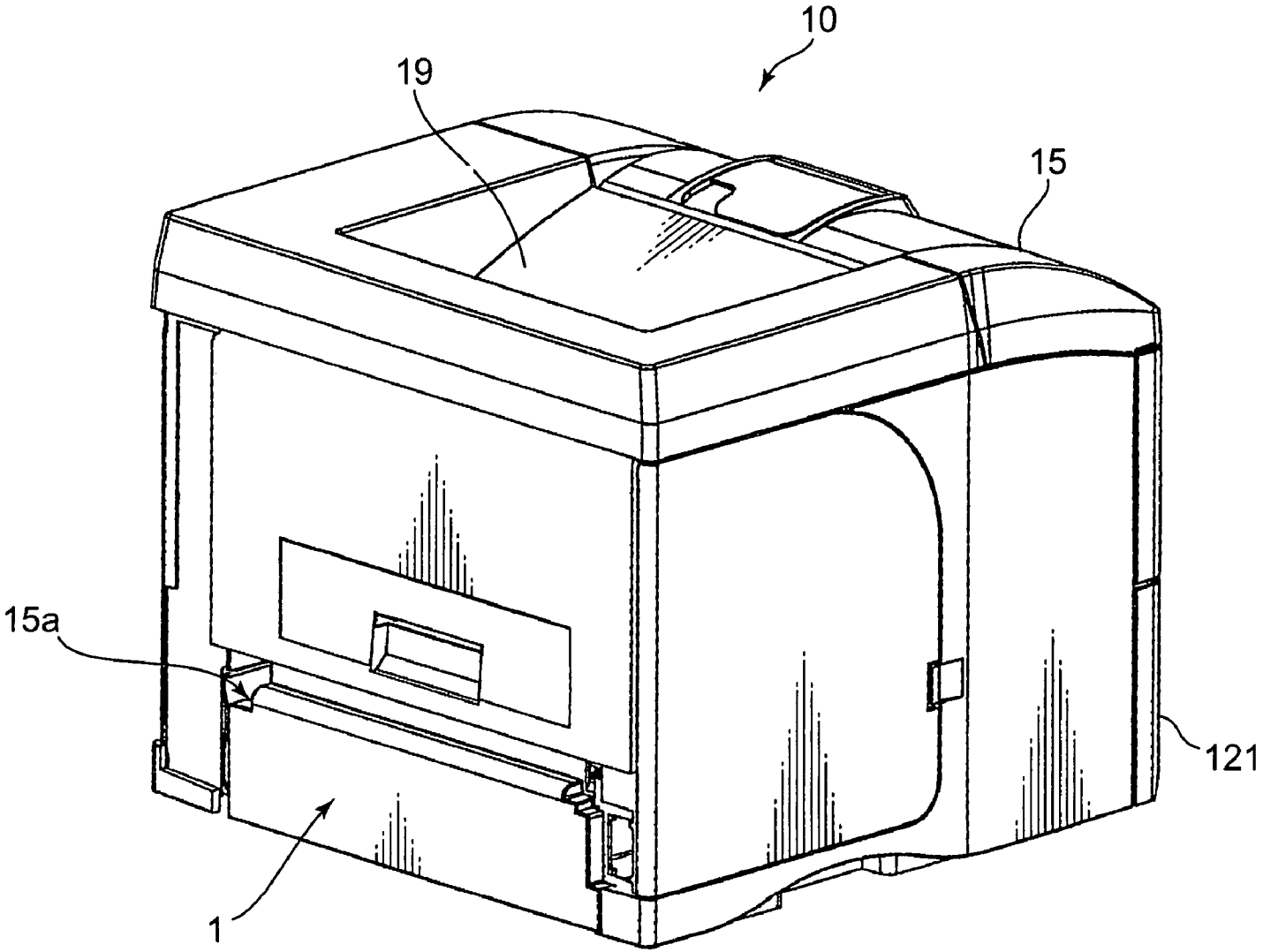
FIG. 1 is a perspective view showing a printer according to one embodiment of the present invention, wherein a sheet feed cassette adjusted to storably receive therein a plurality of sheets having a relatively small size is mounted in the printer.
Figure 2:
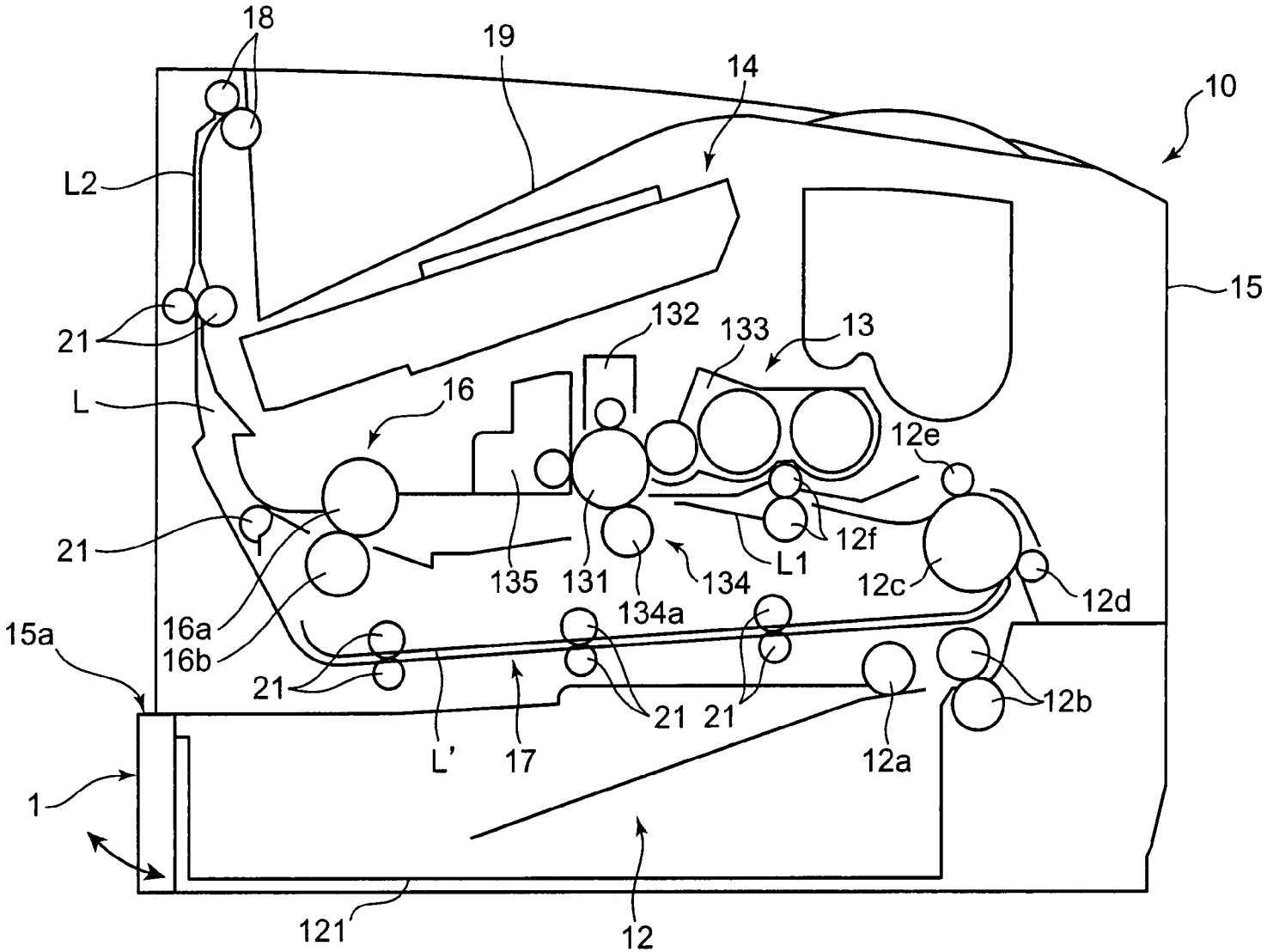
FIG. 2 is a schematic explanatory diagram showing an internal structure of the printer illustrated in FIG. 1.
Figure 3:
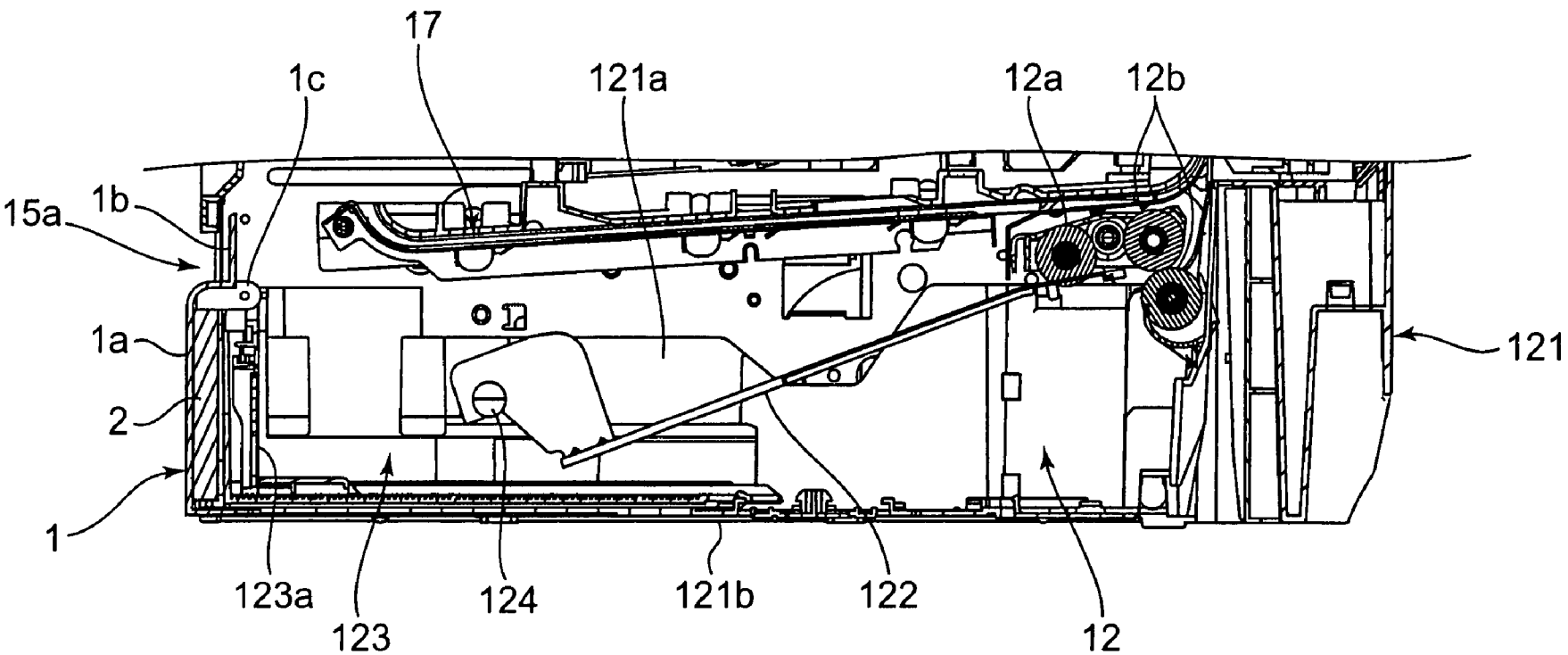
FIG. 3 is a sectional view showing a sheet feed section and its vicinity of the printer illustrated in FIG. 2.
Figure 4:
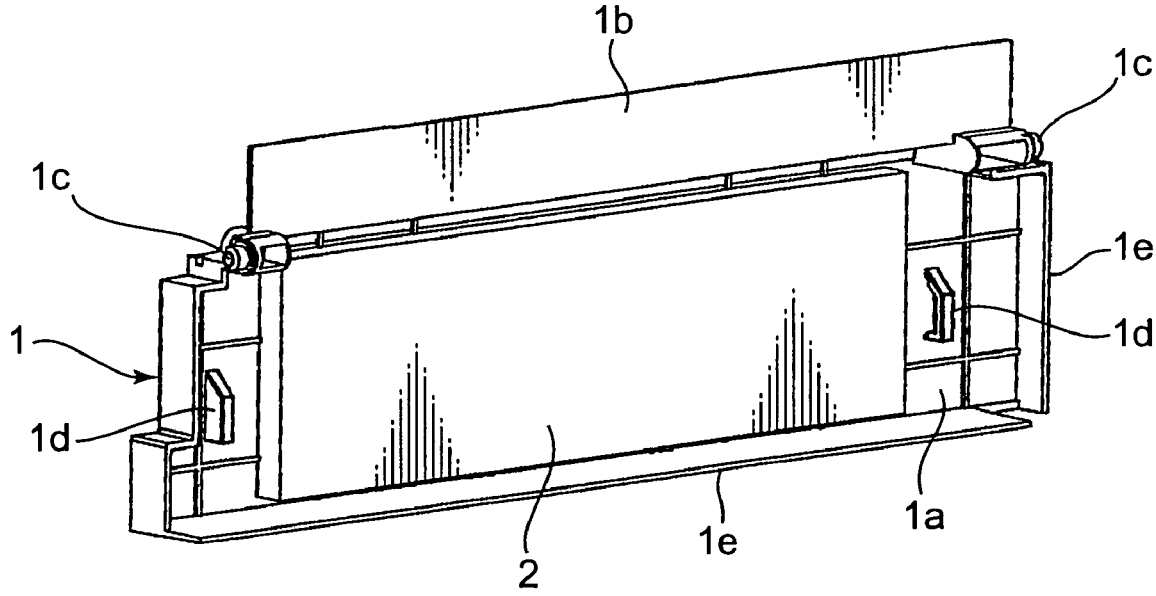
FIG. 4 is a perspective view showing a cover member of the printer illustrated in FIG. 1.

FIG. 1 is a perspective view showing a printer according to one embodiment of the present invention, wherein a sheet feed cassette adjusted to storably receive therein a plurality of sheets having a relatively small size is mounted in the printer. FIG. 2 is a schematic explanatory diagram showing an internal structure of the printer illustrated in FIG. 1. FIG. 3 is a sectional view showing a sheet feed section and its vicinity of the printer illustrated in FIG. 2, and FIG. 4 is a perspective view showing a cover member of the printer illustrated in FIG. 1. With reference to FIGS. 1 to 4, the entire stricture of the printer 10 with the sheet feed cassette 121 mounted therein will be firstly described. The printer 10 according to this embodiment is one example of an image forming apparatus as a subject matter of the present invention.

As shown in FIGS. 1 and 2, the printer 10 is provided with a box-shaped housing 15, and designed to transport a sheet (recording sheet) along a transport path L (see FIG. 2) provided inside the housing 15, and form an image on the sheet based on image data transmitted from a terminal (not shown) or the like. As shown in FIG. 2, the transport path is configured in an approximately L shape in side view which has a horizontal zone L1 extending approximately horizontally in a longitudinal (frontward/rearward) direction of the printer 10, and a vertical zone L2 extending approximately vertically upward from an rear end of the horizontal zone L1. The printer 10 according to this embodiment is dimensionally designed to use a sheet having a relatively small size (e.g. A4 sheet) as a standard sheet, and arrange manual operating means, such as means for insertion/pullout of the sheet feed cassette 121 and means for manual sheet feed, on the side of a front surface (right side in FIG. 2) of the housing 15 so as to provide enhanced operationality thereof.

As shown in FIG. 2, the printer 10 comprises a sheet feed section 12 for storing a plurality of sheets and feeding the sheets one-by-one to an after-mentioned image forming section 13, an image forming section 13 for forming a toner image and transferring the toner image onto the sheet fed from the sheet feed section 12, and a fixing section 16 for fixing the transferred toner image onto the sheet.

The sheet feed section 12 contains the sheet feed cassette 121 which is adapted to be insertingly mounted in the sheet feed section 12 in such a manner that it can be pulled out frontward, and disposed below the horizontal zone L1 of the transport path L. The sheet feed section 12 includes a pickup roller 12*a* operable to pick up the sheets in the sheet feed cassette 121 one-by-one, a plurality of sheet feed rollers 12*b*, 12*c*, 12*d*, 12*e* operable to feed out the sheet to the horizontal zone L1, and a registration roller 12*f* operable to temporarily hold the fed sheet and feed the sheet toward the image forming section 13 at a given timing.

The sheet feed cassette 121 is formed in an approximately rectangular parallelepiped shape having an open upper surface, and adapted to storably receive therein a stack of sheets having a relatively small size (e.g. A4 sheet). More specifically, as shown in FIG. 3, the sheet feed cassette 121 comprises a lift member 122 for lifting a front end of the sheet to bring it into contact with the pickup roller 12*a*, and a size restriction member 123 for restricting a sheet size to be received in the sheet feed cassette 121.

The lift member 122 is formed in a flat plate shape to cover approximately one-half of a bottom plate 121*b* of the sheet feed cassette 121. The lift member 122 has opposite rearward lateral ends each pivotally supported by a corresponding one of two pins 124 mounted, respectively, to opposite side plates 121*a* of the sheet feed cassette 121, in such a manner as to allow a front portion of the lift member 122 to be moved upward and downward relative to the bottom plate 121*b*.

The size restriction member 123 is mounted onto the bottom plate 121*b* of the sheet feed cassette 121 movably along the bottom plate 121*b* in the longitudinal direction. The size restriction member 123 has a rear end provided with a rear-end cursor 123*a* extending upright relative to the bottom plate 121*b*. The size restriction member 123 can be moved relative to the bottom plate 121*b* in the longitudinal direction to receive plural different types of sheets in the sheet feed cassette 121. For example, when a sheet having a relatively small size (e.g. A4 sheet) is received in the sheet feed cassette 121, the size restriction member 123 may be disposed at a relatively frontward position relative to the bottom plate 121*b*. The sheet feed cassette 121 in this state has a longitudinal dimension (i.e. length) slightly less than that of the housing 15.

The housing 15 has a rectangular-shaped opening 15*a* formed in a region thereof which corresponds to a rear end surface of the sheet feed cassette 121 mounted in the sheet feed section 12. This opening 15*a* is provided as a means to allow a rear portion of the sheet feed cassette 221 (see FIG. 5) adjusted to have a longitudinal dimension greater than that of the housing 15 to protrude (escape) rearward from the housing 15 when it is inserted into the sheet feed section 12, as described in detail later.

In this embodiment, a rectangular flat plate-shaped cover member 1 is attached in the vicinity of an upper edge of the opening 15*a* (i.e., attached to the housing 15 at a position adjacent to the upper edge of the opening 15*a*). The cover member 1 is adapted to be rotated in opposite directions for opening and closing the opening 15*a*. Further, a foamed noise absorbing material 2 comprising urethane foam or the like is attached onto a surface of the cover member 1 adapted to be located in opposed relation to the sheet feed cassette 121 (221). The cover member 1 is adapted to be rotated by its own weight in the direction for closing the opening 15*a* when the sheet feed cassette 121 having a longitudinal length less than that of the housing 15 is mounted in the sheet feed section 12, as shown in FIG. 3.

As shown in FIG. 4, the cover member 4 comprises a main cover portion 1*a* holding the noise absorbing material 2, an auxiliary cover portion 1*b* continuously extending from an upper edge of the main cover portion 1*a*, a pair of shafts 1*c* disposed, respectively, at opposite lateral ends of a boundary between the main cover portion 1*a* and the auxiliary cover portion 1*b*, two convex-shaped contact pieces 1*d* formed on the main cover portion 1*a*, respectively, at positions on both lateral sides of the noise absorbing material 2 held by the main cover portion 1*a*, and a flange 1*e* extending inward from and perpendicularly to an outer periphery of the main cover portion 1*a*.

The main cover portion 1*a* and the flange 1*e* around the outer periphery thereof make up a concave-shaped segment having a surface to be opposed to the sheet feed cassette 121, and the noise absorbing material 2 is held in a bottom of the concave-shaped segment. The auxiliary cover portion 1*b* is adapted to cover an upper region of the opening 15*a* so as to fully close the opening 15*a* together with the main cover portion 1*a* when the cover member 1 is located to extend along a vertical direction. Each of the pair of shafts 1*c* is fitted into a bearing (not shown) attached to the housing 15 so as to pivotally support the cover member 1. The contact pieces 1*d* are adapted to come into contact with a rear end surface of the after-mentioned sheet feed cassette 221 having a longitudinal dimension greater than that of the housing 15 when the sheet feed cassette 221 is inserted into the sheet feed section 12, so as to rotate the cover member 1 in the direction for opening the opening 15*a*.

Thus, when the sheet feed cassette 121 having a longitudinal length less than that of the housing 15 is mounted in the sheet feed section 12, the above cover member 1 is rotated by its own weight in the direction for closing the opening 15*a* of the housing 15 to close the opening 15*a* while orienting the noise absorbing material 2 toward the sheet feed cassette 121.

The image forming section 13 is operable to form a toner image on a surface of a photosensitive drum 131 and then transfer the toner image onto the sheet. More specifically, as shown in FIG. 2, the image forming section 13 comprises the photosensitive drum 131 disposed at an approximately longitudinal center of the horizontal zone L1 of the transport path L, a charge device 132 disposed above the photosensitive drum 131, a development device 133 disposed on a frontward side of the photosensitive drum 131, a transfer device 134 disposed below the photosensitive drum 131, a cleaning device 135 disposed on a rearward side of the photosensitive drum 131, and a laser scanner unit (LSU) 14 disposed above the fixing section 16 and the aforementioned components of the image forming section 13.

The photosensitive drum 131 is adapted to be rotated clockwise in FIG. 2. The charge device 132 is operable to uniformly charge the surface of the photosensitive drum 131, and then the laser scanner unit 14 is operable to emit a laser beam based on image data onto the surface of the photosensitive drum 131 through a space between the charge device 132 and the development device 133 so as to form an electrostatic latent image thereon. Then, the development device 133 is operable to supply toner onto the surface formed with the electrostatic latent image so as to form a toner image.

Subsequently, a transfer roller 134*a* as the transfer device 134 is operable to allow the sheet fed from the sheet feed section 12 and transported to the photosensitive drum 131 to be pressed onto the photosensitive drum 131 so as to transfer the toner image formed on the surface of the photosensitive drum 131 to a surface (transfer surface) of the sheet, and then the sheet is transported to the fixing section 16. The cleaning device 135 is operable to remove residual toner and residual charges on the surface of the photosensitive drum 131 after the transfer operation.

The fixing section 16 is provided with a heating roller 16*a* and a pressing roller 16*b* which are operable to nip the sheet having the transferred toner image therebetween so as to fix the toner image onto the sheet by means of heat and pressure.

Then, the sheet having the fixed toner image is ejected into an output portion 19 formed in a top surface of the housing 15 by an ejecting roller pair 18.

The printer 10 according to this embodiment further includes a switchback section 17 arranged between the horizontal zone L1 of the transport path L and the sheet feed cassette 121 to allow an image to be formed on both surfaces of the sheet.

Further, a plurality of transport roller pairs 21 are disposed at appropriate positions between the fixing section 16 and the ejecting roller pair 18 and in a transport path L' of the switchback section 17.

Figure 5:
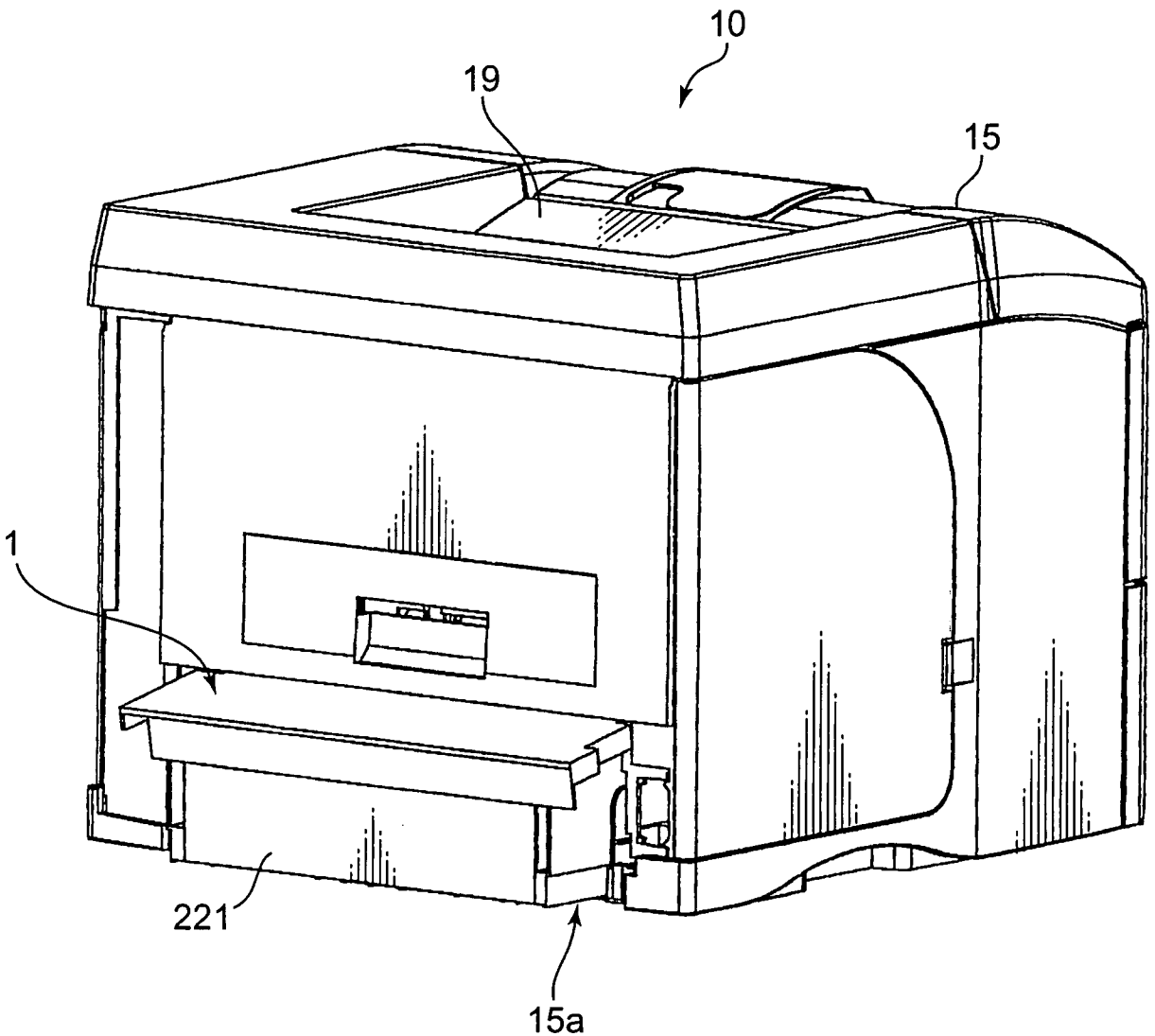
FIG. 5 is a perspective view showing the printer according to the embodiment, wherein the sheet feed cassette adjusted to storably receive therein a plurality of sheets having a relatively large size is mounted in the printer.
Figure 6:
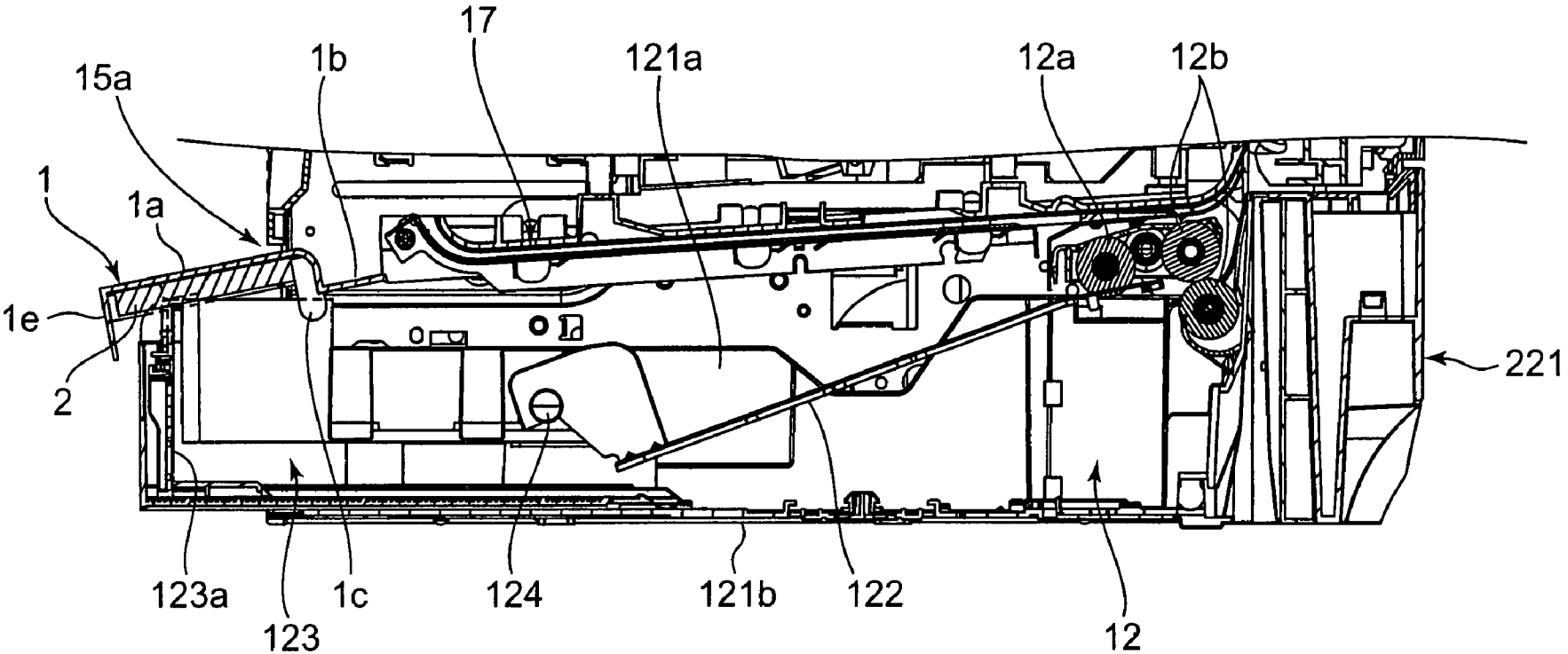
FIG. 6 is a sectional view showing a sheet feed section and its vicinity of the printer illustrated in FIG. 5.

FIG. 5 is a perspective view showing the printer according to the embodiment, wherein the sheet feed cassette adjusted to storably receive therein a plurality of sheets having a relatively large size is mounted in the printer. FIG. 6 is a sectional view showing the sheet feed section and its vicinity of the printer illustrated in FIG. 5. With reference to FIGS. 5 and 6, the printer 10 having the sheet feed cassette 221 adjusted as above will be described.

The sheet feed cassette 221 mounted in the sheet feed section 12 of the printer 10 illustrated in FIG. 5 is adjusted differently from the aforementioned sheet feed cassette 121. Specifically, as shown in FIG. 6, in the sheet feed cassette 221, the size restriction member 123 is disposed at a relatively rearward position relative to the bottom plate 121*b* as compared with the position of the size restriction member 123 in the sheet feed cassette 121, so as to storably receive therein a stack of sheets having a relatively large size (e.g. the aforementioned legal-size sheets). That is, the sheet feed cassette 221 has a longitudinal dimension (i.e. length) greater than that of the sheet feed cassette 121 (i.e., the sheet feed cassette 221 is extended in the longitudinal direction relative to the sheet feed cassette 121).

Thus, when the sheet feed cassette 221 is mounted in the sheet feed section 12, the longitudinal dimension of the sheet feed cassette 221 becomes greater than that of the housing 15, and therefore a rear portion of the sheet feed cassette 221 will protrude rearward from the opening 15*a* formed in a rear portion of the housing 15. Specifically, during an operation of inserting the sheet feed cassette 221 into the sheet feed section 12, a rear end of the sheet feed cassette 221 comes into contact with the contact pieces 1*d* of the cover member 1 attached around the opening 15*a* to push the cover member 1 outward, and thereby the cover member 1 is rotated about the shafts 1*c* in the direction for opening the opening 15*a*. Then, when the sheet feed cassette 221 is inserted such that a front end thereof becomes approximately flush with the front surface of the housing 15, the rear portion of the sheet feed cassette 221 protrudes rearward from the opening 15*a*, and an upper surface of the protruded rear portion of the sheet feed cassette 221 is covered by the cover member 1. In this state, the noise absorbing material 2 attached to the cover member 1 is located on the underside of the cover member 1 in opposed relation to the sheet feed cassette 221.

As described above, in this embodiment, the cover member 1 is adapted to cover the upper surface of the rear portion of the sheet feed cassette 221 protruding from the opening 15*a* of the housing 15, and the noise absorbing material 2 is attached on the surface of the cover member 1 adapted to be located in opposed relation to the sheet feed cassette 221. Thus, internal operating noises (such as sheet pickup noise, driving noise and sheet transport noise during a sheet feeding operation) of the housing 15 which would otherwise leak outside through the sheet feed cassette 221 protruding from the opening 15*a* can be absorbed by the noise absorbing material 2 attached on the sheet feed cassette 221. This makes it possible to prevent internal operating noises of the housing 15 from leaking outside when the sheet feed cassette 221 is mounted to protrude from the housing 15.

In this embodiment, the cover member 1 is adapted to close the opening 15*a* while orienting the noise absorbing material 2 held by the cover member 1 toward the sheet feed cassette 121 when the rear portion of the sheet feed cassette 221 is located within the housing 15, i.e., the rear portion of the sheet feed cassette 221 is mounted without protruding from the opening 15*a*. Thus, internal operating noises of the housing 15 which would otherwise leak outside through the opening 15*a* can be shielded by the cover member 1 and further absorbed by the noise absorbing material 2. This makes it possible to sufficiently prevent internal operating noises of the housing 15 from leaking outside through the opening 15*a*. In addition, the opening 15*a* closed by the cover member 1 makes it possible to prevent a foreign substance, such as dust, from getting into the housing 15 through the opening 15*a*.

In this embodiment, the cover member 1 is adapted to cover the upper surface of the sheet feed cassette 221 protruding from the opening 15*a*, as mentioned above. This makes it possible to prevent the occurrence of a disadvantage, such as void, thin spot or roll contamination due to mote, dust and/or moisture which would otherwise get into the housing 15 through the protruded portion of the sheet feed cassette 221. This also makes it possible to prevent discoloration in the sheets stored in the sheet feed cassette 221 which would otherwise be caused when the sheet feed cassette 221 mounted to protrude from the housing 15 is left for long periods of time.

In this embodiment, urethane foam having excellent noise absorbing performance is used as the noise absorbing material 2. This makes it possible to readily prevent internal operating noises of the housing 15 from leaking outside through the opening 15*a*.

In this embodiment, the cover member 1 is adapted to be rotated by its own weight in the direction for closing the opening 15*a* (in a direction allowing the surface of the cover member 1 having the noise absorbing material 2 attached thereon to face the inside of the housing 15). That is, when the sheet cassette 221 is mounted without protruding from the housing 15, the cover member 1 is rotated to its closed position by its own weight in an automatic manner without being in its open position. This makes it possible to reliably close the opening 15*a* in a simple structure or without providing a special mechanism for closing the cover member 1.

While the above embodiment has been described based on a printer as one example of the image forming apparatus as a subject matter of the present invention, the image forming apparatus of the present invention is not limited to the printer, but may include a copy machine, a facsimile machine and a complex machine.

Figure 7:
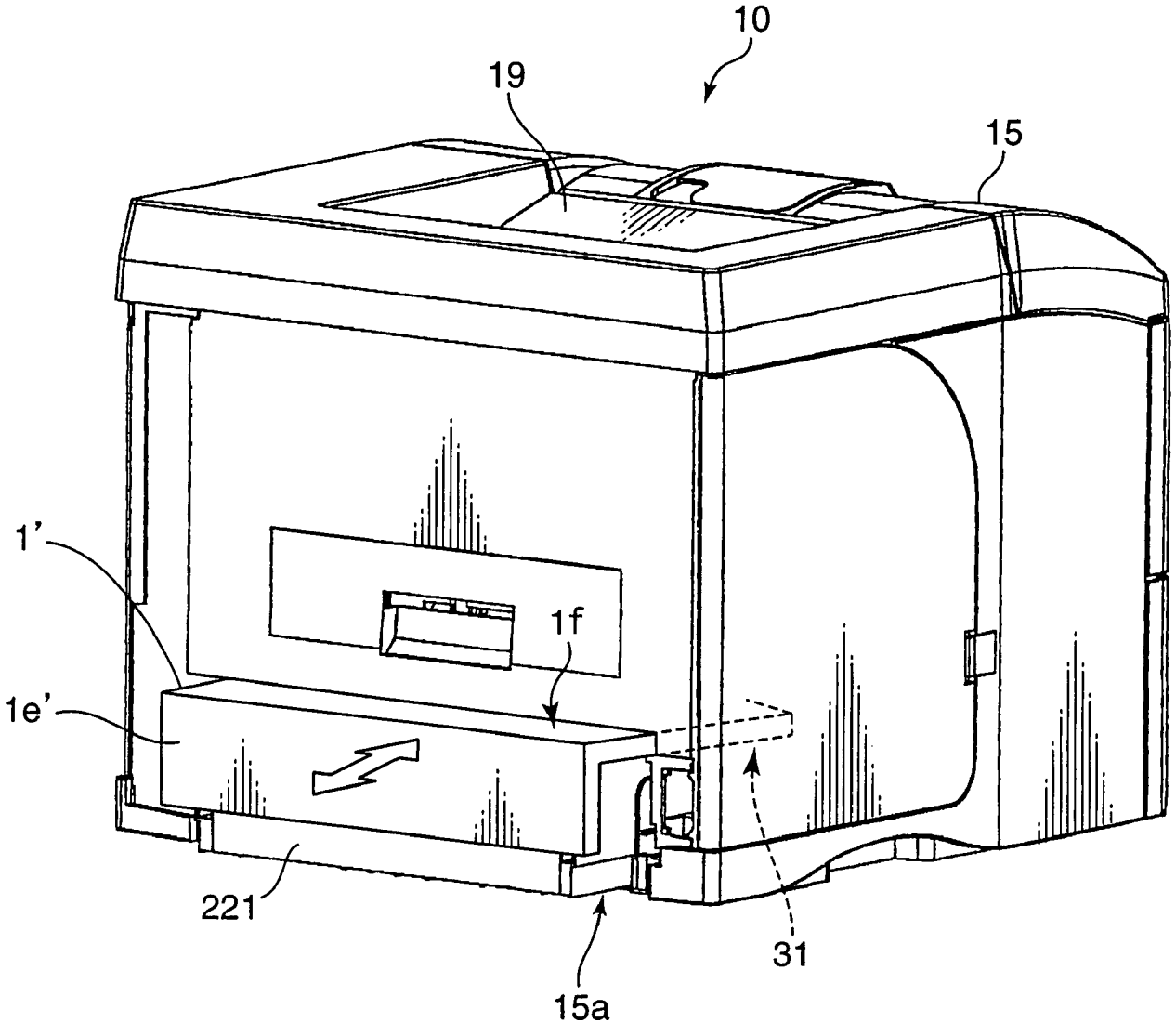
FIG. 7 is an explanatory perspective view showing a printer as one example of modification of the embodiment of the present invention.

While the above embodiment has been described based on one example where the cover member 1 is adapted to be rotated in the direction for opening the opening 15*a* so as to cover an upper surface of the sheet feed cassette 221, and the noise absorbing material 2 is attached thereon, the present invention is not limited to such a structure. For example, the cover member in the present invention may be designed to be slidingly moved in conjunction with an insertion movement of the sheet feed cassette 221 into the sheet feed section 12 so as to cover an upper surface of the sheet feed cassette 221, and the noise absorbing material in the present invention may be attached onto this cover member. Specifically, as shown in FIG. 7, a cover member 1' may be designed to be slidingly moved between a retracted position where the cover member 1' is retracted into the housing 15 and an ejected position where the cover member 1' is ejected rearward from the housing 15, in an upper edge region of the opening 15*a* (in a region of the housing 15 adjacent to the upper edge of the opening 15*a*). More specifically, the housing 15 may be provided with guide means, such as a pair of guide rails 31, for slidably supporting the cover member 1', and the cover member 1' may have opposite lateral edges each formed in a shape (slidably) engageable with a corresponding one of the guide rails 31. Further, a noise absorbing member 2 may be attached onto a surface of the cover member 1' adapted to be located in opposed relation to the sheet feed cassette 221, in the same manner as that in the cover member 1. In this case, the cover member 1' may have a flange 1*e*' (equivalent to the aforementioned flange 1*e*), and designed such that, when the rear portion of the sheet feed cassette 221 is located to protrude rearward from the housing 15 so as to mount the sheet feed cassette 221 in the housing 15, the flange 1*e*' is pressed, for example, by the rear end surface of the sheet feed cassette 221, so as to allow the cover member 1' to be ejected from (pushed out of) the housing 15. As compared with the cover member 1 designed to be rotated, the strength of a support element between the cover member 1' and the housing 15 can be increased (while a support element in the cover member 1 consists of the shafts 1*c* serving as a pivot shaft, a body 1*f* itself of the cover member 1' serves as a support element thereof).

Figure 8:
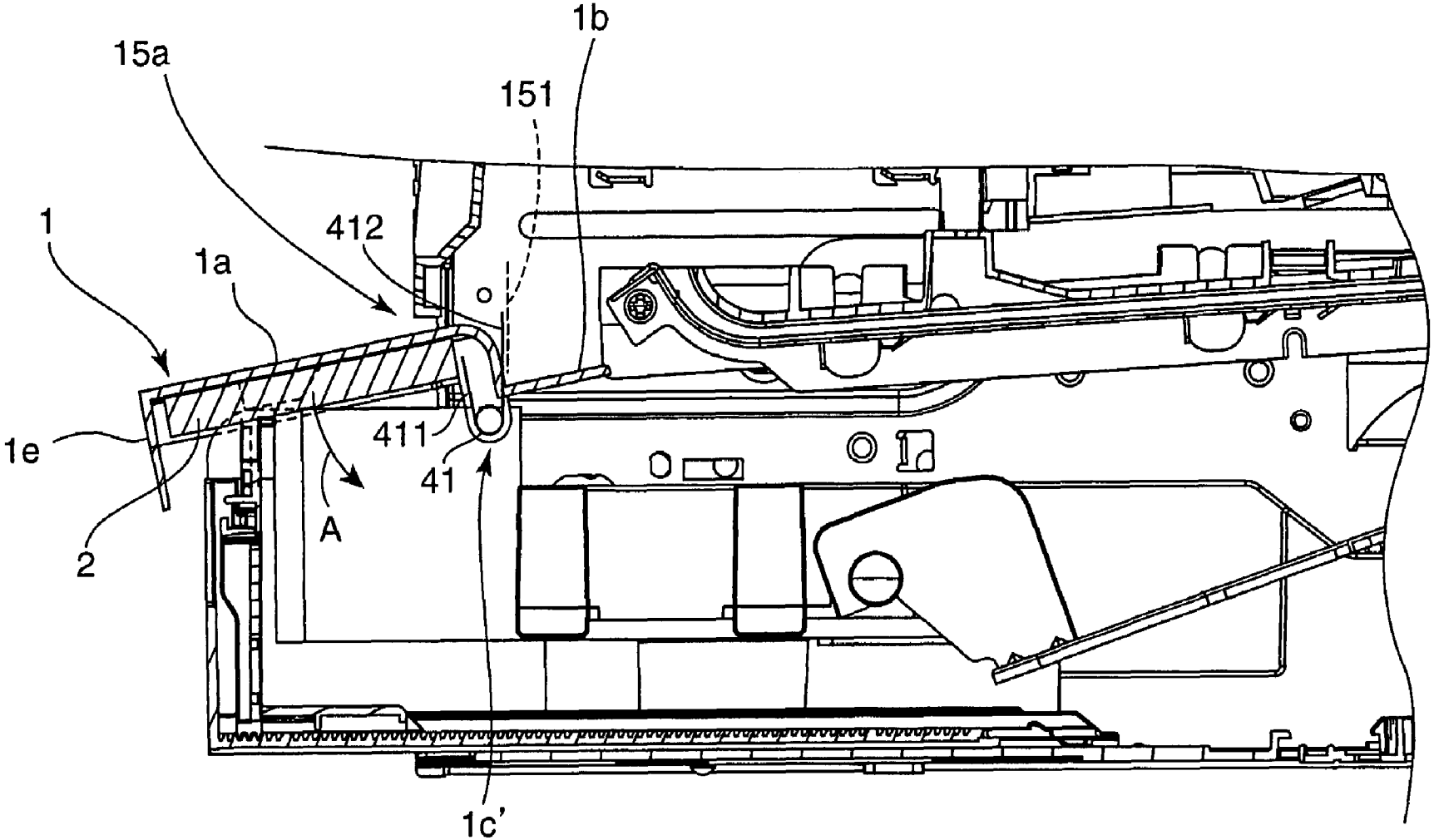
FIG. 8 is a fragmentary enlarged sectional view showing a sheet feed section of a printer as another example of modification of the embodiment of the present invention.

While the above embodiment has been described based on one example where the cover member 1 is adapted to be rotated by its own weight in the direction for closing the opening 15*a*, the present invention is not limited to such a structure. For example, bias means may be used for rotating the cover member 1 in the direction for closing the opening 15*a* (in a direction allowing the surface of the cover member 1 having the noise absorbing material 2 attached thereon to face the inside of the housing 15). Specifically, as shown in FIG. 8, a spring member 41 (a coil spring, such as a torsion spring) may be used as the bias means. Then, one end (latch arm 411) and the other end (latch arm 412) of the spring member 41 may be fixed, respectively, to the cover member 1 and a rear wall 151 of the housing 15, to apply a biasing force to the cover member 1 in a direction indicated by the arrow A in FIG. 8 (in a direction allowing the cover member 1 to be rotated toward the closed position) when the cover member 1 is rotated toward the open position in conjunction with a protruding movement of the sheet feed cassette 221 as shown in FIG. 8.

Thus, when the sheet feed cassette 221 is mounted to protrude from the housing 15, the cover member 1 is pressed against the protruded portion of the sheet feed cassette 221 according to the biasing force to more reliably cover the upper surface of the protruded portion of the sheet feed cassette 221 and thereby further prevent internal operating noises of the housing 15 from leaking outside. In addition, when the sheet feed cassette 221 is disposed without protruding from the housing 15, the cover member 1 is pressed against the opening 15*a* according to the biasing force (the spring member 41 may be fixed to apply the biasing force to the cover member 1 even when the cover member 1 is in the closed position, or may be fixed to apply the biasing force to the cover member 1 only after the cover member 1 starts rotating toward the open position) to more reliably cover the opening 15*a* and thereby further prevent foreign substance, such as dust, from getting into the housing 15 through the opening 15*a*.

This application is based on patent application No. 2005-306995 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An image forming apparatus comprising:

a sheet feed cassette adapted to be insertingly mounted in a sheet feed section of an apparatus body in such a manner that it can be pulled out frontward;

a cover member attached to an upper edge of an opening which is formed in a rear portion of the apparatus body to allow a rear portion of the sheet feed cassette mounted in said sheet feed section to protrude rearward therefrom, said cover member being adapted such that, when the rear portion of said sheet feed cassette is located to protrude from said opening, it covers an upper surface of the protruded rear portion of said sheet feed cassette; and a noise absorbing material attached onto a surface of said cover member adapted to be located in opposed relation to said sheet feed cassette.

2. The image forming apparatus as defined in claim 1, wherein said cover member is adapted to be rotated in opposite directions for opening and closing said opening, said cover member being adapted such that, when the rear portion of said sheet feed cassette is located inside said apparatus body, it is rotated to allow said surface having said noise absorbing material attached thereon to face the inside of said apparatus body so as to close said opening.

3. The image forming apparatus as defined in claim 1, wherein said noise absorbing material includes urethane foam.

4. The image forming apparatus as defined in claim 2, wherein said cover member is adapted to be rotated by its own weight to allow said surface having said noise absorbing material attached thereon to face the inside of said apparatus body.

5. The image forming apparatus as defined in claim 2, which further comprises bias means for applying a biasing force to said cover member to allow the surface of said cover member having said noise absorbing material attached thereon to face the inside of said apparatus body.

6. The image forming apparatus as defined in claim 1, wherein:

said cover member is adapted to be slidably moved in conjunction with an insertion movement of said sheet feed cassette into said sheet feed section so as to cover the upper surface of said sheet feed cassette.

* * * * *